US008549887B2

(12) United States Patent
Reid et al.

(10) Patent No.: US 8,549,887 B2
(45) Date of Patent: Oct. 8, 2013

(54) TEXTILE PRODUCT TREATING APPARATUS HAVING AN ULTRASONIC CLEANING DEVICE

(75) Inventors: Nicola Reid, Pordenone (IT); Jerome Esteve, Porcia (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 733 days.

(21) Appl. No.: 12/302,595

(22) PCT Filed: May 25, 2007

(86) PCT No.: PCT/EP2007/004660

§ 371 (c)(1),
(2), (4) Date: Apr. 22, 2009

(87) PCT Pub. No.: WO2007/137773

PCT Pub. Date: Dec. 6, 2007

(65) Prior Publication Data

US 2009/0235697 A1 Sep. 24, 2009

(30) Foreign Application Priority Data

May 26, 2006 (EP) ..... 06010785

(51) Int. Cl.
*B08B 3/12* (2006.01)
*D06F 37/00* (2006.01)

(52) U.S. Cl.
USPC ..... 68/3 R

(58) Field of Classification Search
USPC ..... 68/3 R
See application file for complete search history.

(56) References Cited

U.S. PATENT DOCUMENTS

| | | | |
|---|---|---|---|
| 4,535,610 | A | 8/1985 | Fey et al. |
| 7,665,227 | B2 | 2/2010 | Wright et al. |
| 2002/0134117 | A1 | 9/2002 | Arai et al. |

(Continued)

FOREIGN PATENT DOCUMENTS

| | | | |
|---|---|---|---|
| DE | 2206039 | A1 | 8/1973 |
| DE | 2512678 | A1 | 9/1976 |

(Continued)

OTHER PUBLICATIONS

Office Action issued on Sep. 20, 2010 in related Chinese Application No. 200780019369.5 (English translation only).

(Continued)

*Primary Examiner* — Michael Kornakov
*Assistant Examiner* — Jason Ko
(74) *Attorney, Agent, or Firm* — Banner & Witcoff, Ltd.

(57) ABSTRACT

The invention relates to a textile product treating apparatus, in a particular washing machine (1) or a dryer, comprising a main body (4) of the apparatus including a washing and/or drying device; an ultrasonic cleaning device (30) comprising an ultrasonic transducer and an ultrasonic wave emitting surface (36); and a treatment area (14) adapted to place a textile product to be treated thereon. According to the invention, the textile product treating apparatus is provided with a moveable tray (12), wherein the treatment area (14) is arranged on or over the moveable tray; and a moving mount connecting the movable tray (12) to the main body (4) and adapted to guide a movement of the moveable tray between a retracted position and a working position, wherein in the retracted position the moveable tray is retracted in the main body (4) and in the working position the tray is extending beyond the base area of the main body.

25 Claims, 5 Drawing Sheets

(56) References Cited

U.S. PATENT DOCUMENTS

Figure 1:
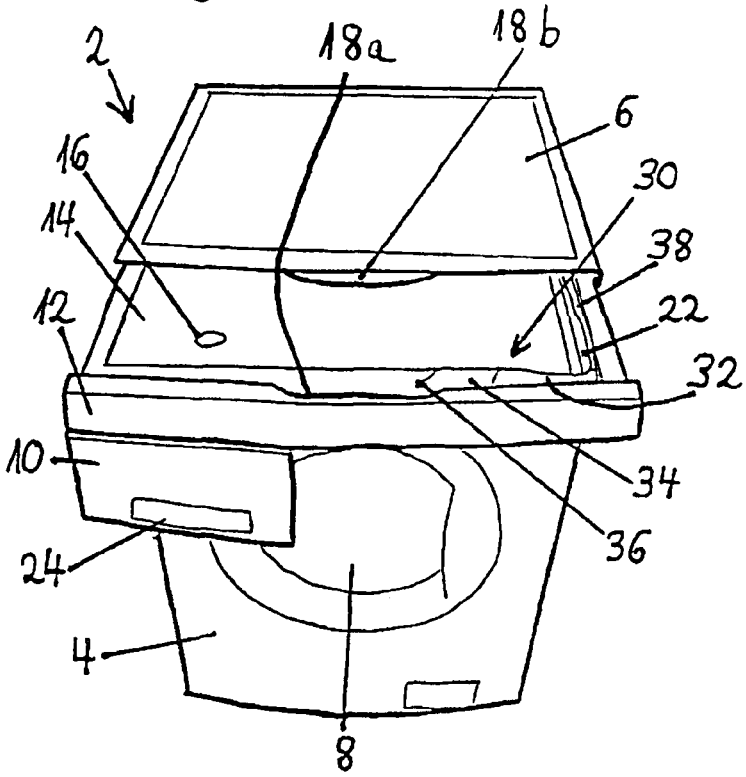

| | | | | |
|---|---|---|---|---|
| 2003/0084535 | A1 | 5/2003 | DuVal et al. | |
| 2005/0056059 | A1 * | 3/2005 | Usherovich et al. | 68/12.02 |
| 2005/0155622 | A1 * | 7/2005 | Leis | 134/1 |

FOREIGN PATENT DOCUMENTS

| | | | |
|---|---|---|---|
| DE | 19832675 | A1 | 1/2000 |
| EP | 1369524 | A1 | 12/2003 |
| EP | 1550755 | A1 | 7/2005 |
| JP | 57122889 | A | 7/1982 |
| JP | 11146995 | A | 6/1999 |
| JP | 2002035485 | A | 2/2002 |
| JP | 2002191892 | A | 7/2002 |
| JP | 2003245497 | A | 9/2003 |
| WO | 03/035961 | A2 | 5/2003 |

OTHER PUBLICATIONS

Office Action issued on Mar. 9, 2011 in related Russian Application No. 2008151700 (including English translation.

* cited by examiner

TEXTILE PRODUCT TREATING APPARATUS HAVING AN ULTRASONIC CLEANING DEVICE

The invention relates to a textile product or fabrics treating apparatus, in particular to a washing machine or a dryer, comprising an ultrasonic cleaning device and a treatment surface for treating textile products.

US 2002/0134117 A1 discloses a washing machine comprising an ultrasonic partial washing apparatus. In one embodiment the ultrasonic partial washing apparatus is stationarily mounted above the loading opening of the top loader washing machine. The sonotrode of the ultrasonic partial washing apparatus points downward to the opening of the washing machine and a textile to be cleaned by the partial washing apparatus is passed along the bottom surface of the sonotrode to clean stained areas of the textile. In another embodiment the partial washing apparatus is formed as a hand-held wand connected via a flexible hose to the washing machine. Electrical leads to the transducer within the wand and a liquid pipe connected to a nozzle in the wand run within the flexible hose, such that the wand is supplied with liquid and electrical energy from the main body of the washing machine.

The washing machine of EP 1 369 524 A1 has an ultrasonic partial washing apparatus arranged at the top side of the washing machine. In a top loader embodiment the ultrasonic apparatus can be swung in a horizontal plane from a rest position to a working position located over the loading opening of the top loader drum. In a front loader or tumbler embodiment the ultrasonic apparatus is stationary mounted below a top cover of the washing machine. In both embodiments the textiles to be cleaned can be drawn through a treatment gap between the ultrasonic apparatus bottom side and a working platform. The active working platform is surrounded by a sink for draining the cleaning liquid through a hole into the tub of the tumbler.

It is an object of the invention to provide a textile product treating apparatus having an ultrasonic cleaning device, wherein the apparatus has a high flexibility in view of the apparatus' installation location. It is another object of the invention to provide an ultrasonic cleaning device having an improved ergonomics in use.

According to an aspect of the invention, a textile product or fabrics treating apparatus is provided having a main body and an ultrasonic cleaning device. The ultrasonic cleaning device has an ultrasonic transducer for producing ultrasonic waves and an ultrasonic wave emitting surface to transfer the ultrasonic waves from the surface to the surface of a textile product to be treated. The ultrasonic cleaning device is sometimes called a partial washing apparatus and is used to treat small areas on the textile product which are stained. A treatment area is provided at the textile product treating apparatus, such that the textile product to be treated by the ultrasonic wave can be placed thereon and then the emitting surface of the ultrasonic cleaning device is brought into contact with the textile product for cleaning. According to an aspect of the invention, the treatment area is arranged on or above a moveable tray, wherein the moveable tray can be moved between a working position and a retracted position using a moving mount. In the retracted position the moveable tray does not disturb the functionality of the textile product treating apparatus when conventionally used (i.e. without ultrasonic cleaning), and preferably the moveable tray is retracted in a way that it disappears within the outer dimensions or outer case of the product treating apparatus with no or only minimal change to the outer appearance of the product treating apparatus. More preferably the moveable tray is completely retracted into the main body of the treating apparatus in the retracted position, for example covered by a cover or bezel which may form an edge of the moveable tray.

According to a further aspect, the working position for the moveable tray is extending beyond the base area or footprint of the main body, such that an additional working space or treatment area is provided, when the moveable tray is in its working position. When for example considering a free-standing washing machine as an example of a treating apparatus, the top cover of the washing machine can be used to place a basket with dirty laundry thereon, which is then taken out of the basket, transferred to the treatment area for treating it with the ultrasonic cleaning device and then the pre-treated laundry is transferred into the drum of the washing machine for a conventional wash. If as another example the treating apparatus is a washing machine placed below a work top of a kitchen line, then the treatment area can be provided by pulling out the moveable tray as soon as and only when there is need for ultrasonic cleaning. Therefore, there is no limitation where the treating apparatus may be placed within the home.

In a preferred embodiment the moving mount guides the moveable tray in such a way that it is retracted at the front side of the main body which restricts the requirement for access to the treating apparatus to the apparatus' front side only. No access to the apparatus sides, top side or back side is required for normal textile product treating and ultrasonic pre-treating.

In a preferred embodiment the moveable tray is either a drawer or a rotary mounted tray, such that the moving mount can be constructed by simple and reliable elements. In particular, the extension of the treatment area may be high, thereby providing a convenient workspace for pre-treatment with the ultrasonic cleaning device, for example if the drawer extends the full or nearly the full width of the front side of the treating apparatus. In addition, space requirements within the main body of the apparatus for retracting the moveable tray and for mounting the moving mount are minimal and simple for integration.

Preferably, the ultrasonic cleaning device is a hand-held device and preferably connected to the main body by a flexible hose, such that—when pre-treating textile products—the operating range for a user extends to a wide area.

In a preferred embodiment the moveable tray comprises a sink, such that, when cleaning liquid is used for ultrasonic cleaning, the liquid is collected by the sink and can be discharged therefrom into a predefined direction, for example through a hole provided at the sink or through a hose extending from the sink. Preferably, the sink is very shallow, for example formed at the top surface of a drawer or a rotary mounted tray, such that the shallow sink does not or not substantially affect the required height of the moveable tray.

Preferably, a drain extends from the moveable tray (e.g. the sink) and drains the collected liquid into a washing tub, a detergent drawer or a liquid tank unit. Thereby, it is not necessary for the user to manually remove the liquid from the moveable tray. If for example the textile product treating apparatus is a dryer, in which condensed humidity from laundry to be dried is collected in a liquid tank, then this tank can also be used for collecting the liquid flown off the textiles pre-treated by the ultrasonic cleaning device at the treatment area.

In a preferred embodiment the moveable tray is arranged above a drawer. Then in a further embodiment the drawer can be used for draining out or collecting the liquid draining from the treatment area during ultrasonic cleaning, such that for example no pump is required for removing the liquid from the tray. In an additional or alternative embodiment the moveable tray or the moving mount of the moveable tray abuts at least partially against the drawer in its pulled-out position, such that the mechanical stability of the moveable tray is thereby improved or facilitated. For example, the drawer forms the moving mount or part of the moving mount. Preferentially, an engagement element is provided, which engages with the drawer, when the moveable tray is moved from its retracted position to its working position. Thereby, the drawer is brought into a position where it can support the moveable tray and/or collect the liquid draining off from the moveable tray.

According to a preferred embodiment, the moveable tray is mounted on a drawer conventionally used for example as detergent drawer or drawer for collecting condensed water in a condenser dryer, such that the treatment area is provided by just pulling out the drawer from the main body. Preferably, the moveable tray is a cover or plate being pivotably mounted at the drawer, such that, when the moveable tray is swung aside, compartments below the cover or moveable tray can be accessed for filling in for example liquid or detergents used for washing the laundry.

Preferably, a sealing device is arranged at the opening of the main body, the moveable tray and/or the moving mount, such that the opening of the main body is at least partially sealed against penetration of liquid from the outside of the apparatus into its main body, for example the liquid used for partial washing by the ultrasonic cleaning device. For example, a sealing device is arranged at an end surface of a drawer or the pivotably mounted tray, such that, when guiding the moveable tray into its working position, the opening at the main body is automatically closed. In a preferred embodiment (a) detent element(s) is/are provided, which is or are assigned to the working and/or retracted position of the moveable tray, such that the moveable tray and/or the moving mount are locked in the working and/or retracted position against a detent force.

In a preferred embodiment the moveable tray and/or a drawer comprise/s a compartment for storing the ultrasonic device and/or a portion of a hose connecting the ultrasonic device to a supply unit. Thereby, the ultrasonic cleaning device can be discretely stored in the moveable tray or in the drawer, when it is not necessary to pre-treat the textile products.

In a further embodiment the apparatus comprises a heater element adapted to heat the liquid supplied to the nozzle of the ultrasonic device. In a further embodiment a sensor device is provided, which is adapted to detect said ultrasonic wave emission surface being in contact or in close proximity to an object (i.e. the laundry) and to provide a detection signal. Additionally or alternatively, a control device is connected to the sensor device and adapted to stop the operation of said ultrasonic transducer, when the detection signal is not provided. Preferably, the sensor device is a switch arranged within a body of said ultrasonic cleaning device and said control device comprises a switchable contact of the switch; or it is a position detector adapted to detect the variable position of the ultrasonic wave emitting surface being close to or at the opening; or it is a proximity switch adapted to detect a distance between the ultrasonic wave emitting surface and an object. Preferably, the body of the ultrasonic cleaning device comprises at least two parts, wherein a tip body part having an opening for the US emitting surface is movably arranged at a main body part, and wherein said sensor device is adapted to detect at least one position of the tip body part relative to the main body part.

In a preferred embodiment a liquid supply device supplying liquid to the ultrasonic cleaning device comprises a detergent mixing member. Alternatively or additionally, the liquid supply device comprises an activation member adapted to activate supply of liquid to the nozzle of the ultrasonic cleaning device.

Preferably, the activation member comprises a detector adapted to detect the operation of the ultrasonic transducer. Preferably, the ultrasonic cleaning device or the textile treating apparatus comprises a liquid supply device and the ultrasonic cleaning device has a nozzle connected to the liquid supply device for spraying a liquid onto a textile product. Preferably, the liquid supply device is connected to a fresh water supply line and/or comprises a supply pump.

According to claim 23, a hand-held ultrasonic cleaning device is provided, having an ultrasonic transducer and an ultrasonic wave emitting surface connected to the ultrasonic transducer, wherein a body of the ultrasonic cleaning device is made of at least two body portions being moveably connected to each other. The connection between the two body portions is made by a connecting means enabling a relative movement between the first and second body portion, such that the first and second body portions can be adjusted at different angles to each other. This allows for example to stretch the body of the ultrasonic cleaning device for storing purposes, when only a small elongate storing compartment or a small retaining opening is available. On the other hand, the body of the ultrasonic cleaning device can be bent by moving the first and second body portions to assume an angled position to each other, such that holding the ultrasonic cleaning device is much more comfortable as compared to holding the stretched ultrasonic cleaning device.

Preferred embodiments of the ultrasonic cleaning device have been described above in connection with the treatment apparatus and are fully applicable here as regards the features of the ultrasonic cleaning device.

Figure 2:
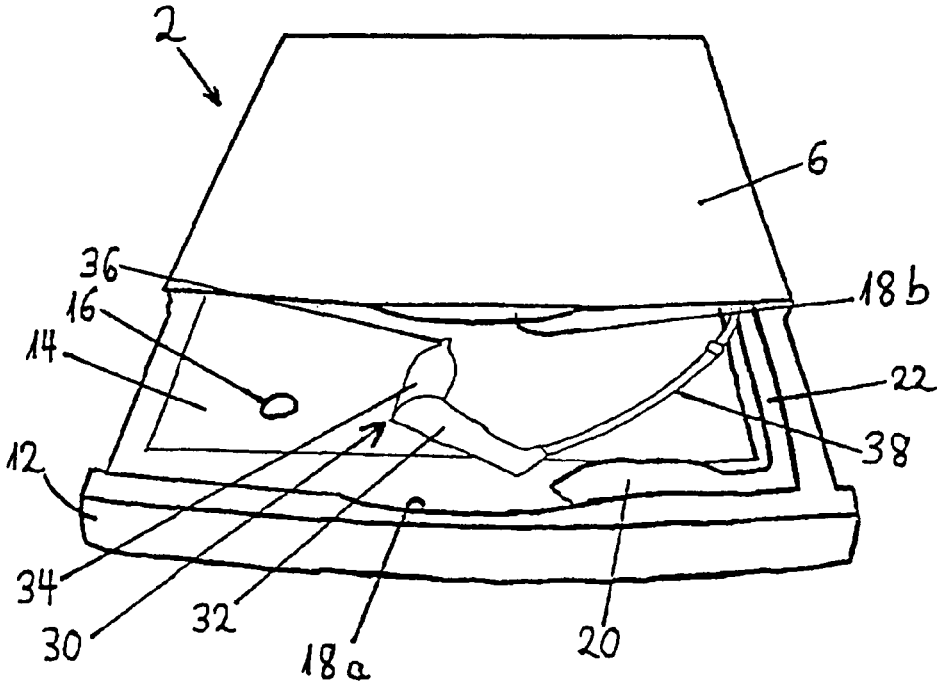
Figure 3:
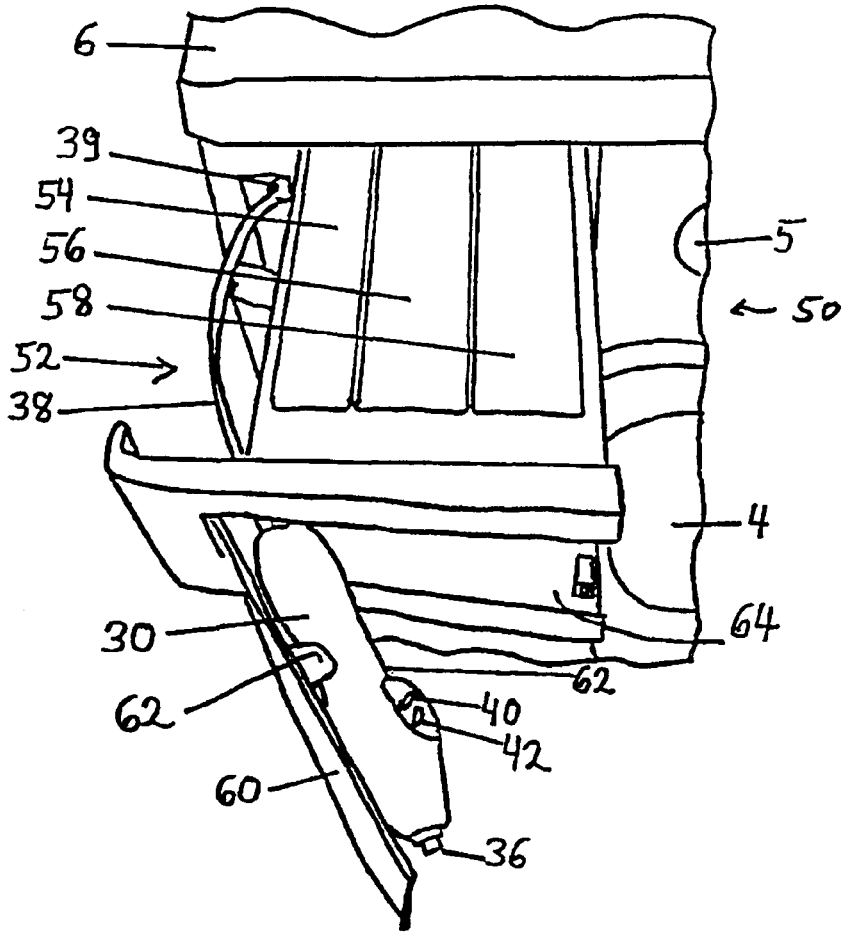
Figure 6:
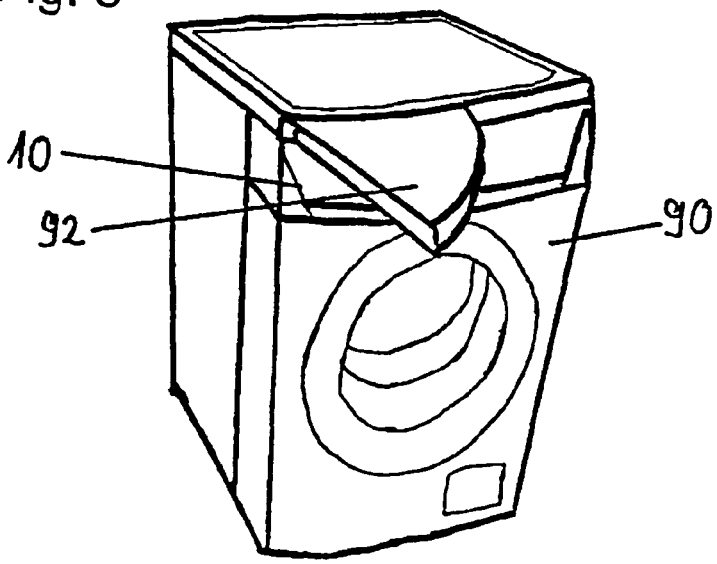
Figure 4B:
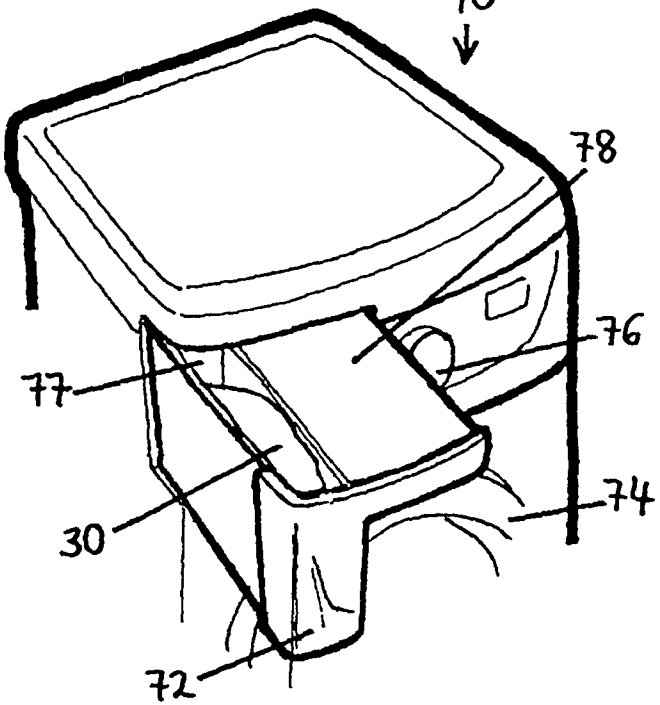
Figure 4A:
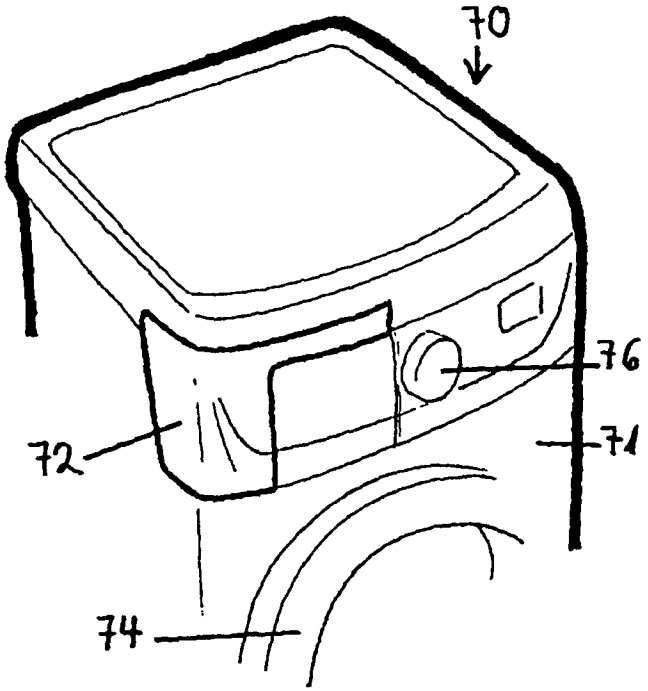
Figure 5B:
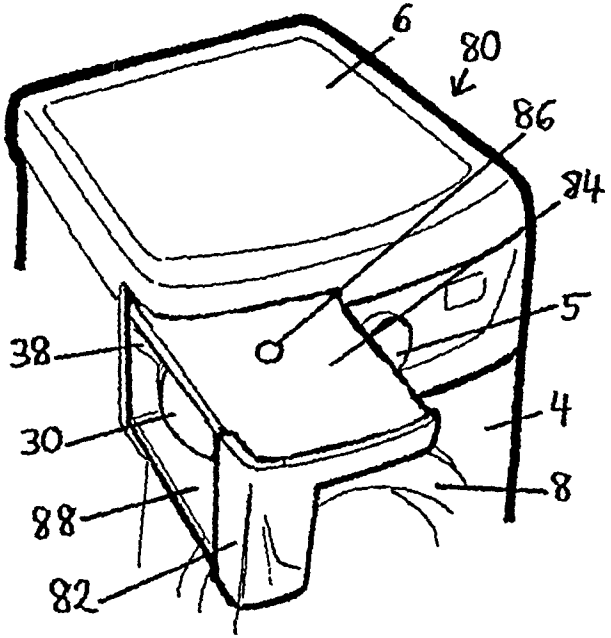
Figure 5A:
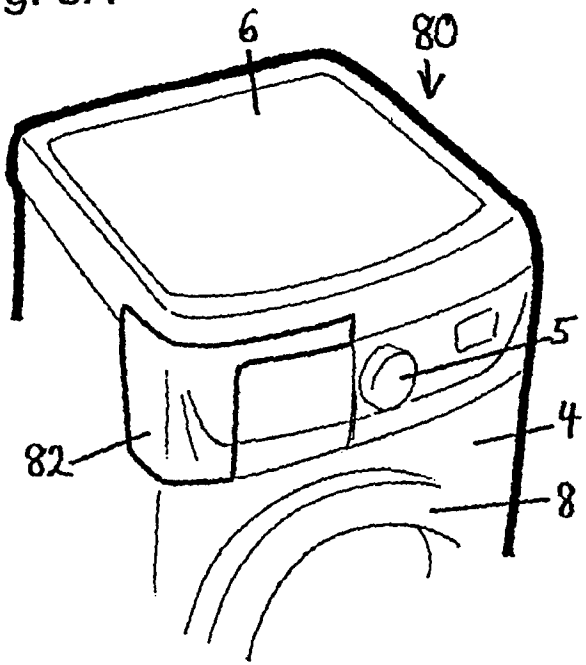
Figure 7A:
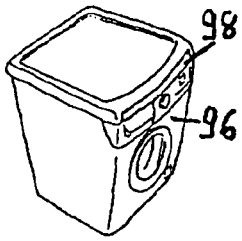
Figure 7B:
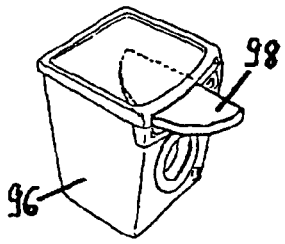
Figure 7C:
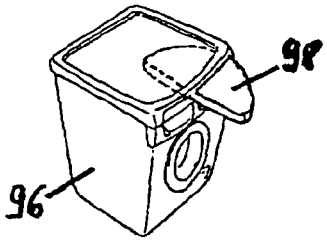
Figure 8:
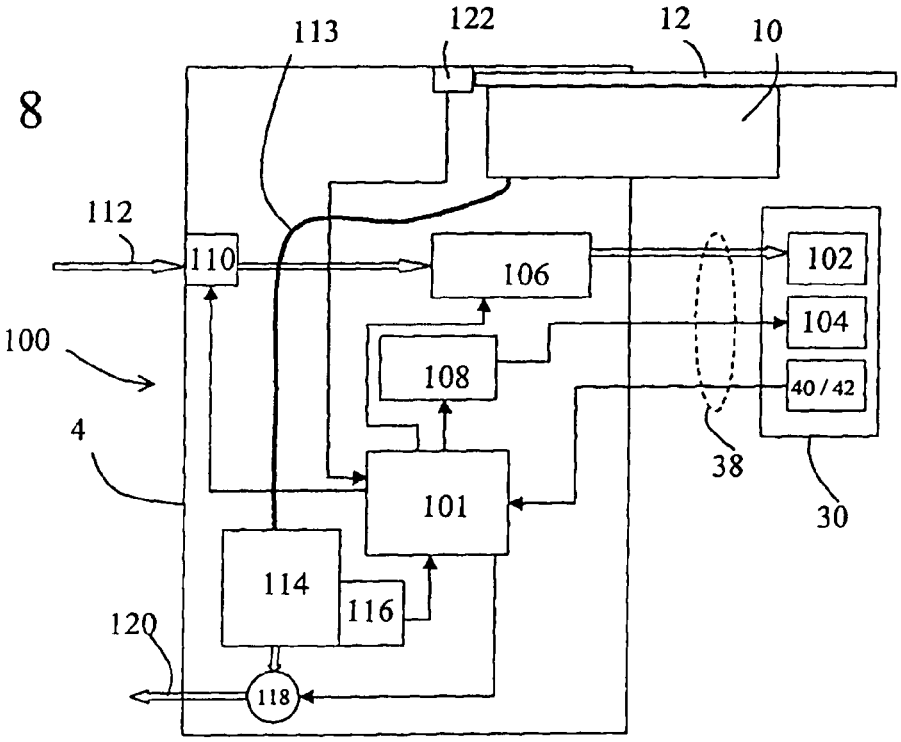

Reference is made in detail to preferred embodiments of the invention, examples of which are illustrated in the accompanying drawings. The drawings show:

FIG. 1 a perspective view of a washing machine having a worktop drawer;

FIG. 2 a partial view to the worktop drawer of FIG. 1;

FIG. 3 another embodiment of a washing machine having an ultrasonic cleaning device integrated in a detergent drawer;

FIGS. 4A and 4B partial perspective views of a dryer having a condensate drawer with an ultrasonic wand therein;

FIGS. 5A and 5B partial perspective views of a further embodiment of a washing machine having a work cover mounted on a detergent drawer;

FIG. 6 a perspective view of a further embodiment of a washing machine having a pivotable tray;

FIG. 7A to 7C perspective views of another embodiment of a washing machine having a pivotable tray; and FIG. 8 a block diagram illustrating the functional connection of elements of the washing machine shown in FIG. 1.

FIG. 1 shows a perspective view of a washing machine 2 according to a first embodiment. The top surface of the washing machine's main body 4 is formed by a top cover 6 which can be used in a conventional manner, for example for storing detergent packets or the like. The washing machine 2 is a tumbler having a front loading door 8 and a program selector 5 at the front side of the main body 4. A detergent drawer 10 is provided for storing the liquid and powder detergents (compare for example FIG. 3 showing a detergent drawer 52 having compartments 54, 56 and 58). A worktop drawer 12 is arranged below the top cover 6 and above the detergent drawer 10 to be pulled out at the front side of the washing machine. The worktop drawer 12 has a worktop 14 to place laundry thereon to be treated by ultrasonic cleaning. A draining hole 16 is provided at the worktop 14 located over the main wash detergent compartment (compare reference numeral 56 in FIG. 3), when the worktop drawer 12 and the detergent drawer 10 have been pulled out, as shown in FIG. 1.

The front face of the top cover 6 has a recess 18*a* and the back face of the front frame of the worktop drawer 12 has a mating recess 18*b*. When the worktop drawer 12 is fully retracted within the washing machine's main body 4, recesses 18*a* and 18*b* form a common recess convenient to grip the front frame of the worktop drawer 12 and to pull out the worktop drawer 12 from its recessed position to its working position (position at maximum pull-out as shown in FIG. 1). On the top side of the worktop drawer 12 a compartment 20 for storing an ultrasonic wand 30 and a groove 22 therein are formed, the latter being adapted to receive a hose 38 connecting the ultrasonic wand 30 to a supply unit internally arranged to the main body 4.

An engagement pin (not shown) is formed on the bottom side of the worktop drawer 12 and extends into the upper opening of detergent drawer 10. When the worktop drawer 12 is drawn out of the main body 4 into its working position, the engagement pin abuts against an elevated element (not shown) of the detergent drawer 10, such that pulling out the worktop drawer 12 also pulls out simultaneously the detergent drawer 10. On the other hand, the detergent drawer 10 can be pulled out using grip 24 arranged at the front bezel of the detergent drawer 10, wherein the engagement member is released, such that, when detergent drawer 10 is drawn out of the main body 4, the worktop drawer 12 remains in its retracted position.

As shown in FIG. 2, the ultrasonic wand 30 can be taken out of the compartment 20, and the flexible hose 38 allows the user to freely move the ultrasonic wand 30 over the worktop area 14. The ultrasonic wand 30 has an emitter 36 at its tip portion, which emits the ultrasonic waves. Thereby, the ultrasonic wand 30 can be used to treat stained locations of laundry placed on the worktop 14. Liquid assisting the ultrasonic cleaning is sprayed from a nozzle arranged at the front portion of the ultrasonic wand 30 onto the laundry. Excessive liquid then flows down the worktop 14 formed like a slight concave surface or sink terminating at the drain opening 16 and is drained from there into the compartment within the detergent drawer 10. By means of the engagement member between the worktop drawer 12 and the detergent drawer 10 it is always guaranteed that the drain 16 is located over the detergent drawer and that no liquid can drop onto the floor space in front of the washing machine 2 or into an internal space of the washing machine which is not convenient to receive the liquid.

In an embodiment not shown, the drain 16 is shifted to a rear section of the worktop drawer 12, such that it is invisible in the pulled-out or working position of the worktop drawer 12. However, as the main wash compartment 56 or one of the other compartments 58, 54 (see FIG. 3) is elongate, the liquid from the ultrasonic cleaning still drops into the compartment of the detergent drawer 10 avoiding liquid droplets falling into the interior of the washing machine.

FIG. 1 shows the ultrasonic wand 30 in its stretched state, while FIG. 2 shows the wand in its angled state. A pivoting hinge (not shown) is formed between a proximal portion 32 and a distal portion 34 of the ultrasonic wand body, wherein the end faces between the proximal and distal portions 32, 34 are inclined to the longitudinal axis of the ultrasonic wand 30 in its stretched state. Thereby, by turning the distal portion 34 relative to the proximal portion 32 by for example 450 to 900, the two states may be transformed into one another just by turning the distal portion 34. Some users may prefer using the ultrasonic wand 30 in its stretched state, while others use it in the angled state. Preferably, the states depicted in FIGS. 1 and 2 are final states and only a restricted pivoting angle is allowed, such that the electrical wires and fluid hoses running from the proximal portion to the distal portion are not overstressed when turning the distal portion 34 between the two final states. In a further embodiment it can be provided that the ultrasonic wand is only activated in the angled state as a security measure in order to prevent operation of the ultrasonic wand in its stretched state, when it is placed in the compartment 20, which means that it is not in use.

FIG. 3 shows a partial perspective view of a washing machine 50 according to a second embodiment. A detergent drawer 52 is arranged at the front side of the washing machine 50 having a prewash compartment 54, a main wash compartment 56 and a softener compartment 58. The bezel of the detergent drawer 52 is partially formed of a door 60. The ultrasonic wand 30 is held in this embodiment by a holder 62 arranged at the inside of door 60, such that the wand 30 can be snapped in and taken out of the holder 62. Behind the door 60 the detergent drawer 52 houses a compartment 64, in which the ultrasonic wand 30 is stored when not in use. A magnet arranged at the compartment 64 and a metal plate arranged on the inside of the door 60 holds the door 60 in its closed position, when the wand 30 is not in use. The flexible hose 38 connecting the wand 30 to the supply unit internal to the washing machine runs here through a hole in the compartment 64 and through an opening 39 arranged at the side of the drawer 52. In this embodiment as well as in the other embodiments and the dryer shown in the other figures, the flexible hose is automatically wound up on a reel being spring-biased.

The ultrasonic wand shown in FIG. 3 has a single piece body housing an ultrasonic button 40 for switching on the ultrasonic transducer, such that the emitter 36 emits the ultrasonic sound. The body also houses a fluid button 42 which, when pressed, activates the liquid supply of the supply unit, such that liquid is sprayed out of a nozzle at the ultrasonic wand (not shown) onto the laundry to be treated.

In the washing machine 50 of FIG. 3 the laundry to be cleaned by the ultrasonic wand 30 is laid over the pulled out detergent drawer 52 and the liquid draining off from the laundry to be treated drops into one of the compartments 54, 56, 58 and from there into the washing tub of the washing machine.

FIGS. 4A and 4B each show a partial perspective view of a dryer 70 having a drawer 72 shown in the fully retracted position in FIG. 4A and in the fully pulled-out position (working position) shown in FIG. 4B. At the front side of the dryer's body 71 a program selector 76 and a loading door 74 are arranged. The drawer 72 has a storing compartment 77 for storing the ultrasonic wand 30 connected by the flexible hose to the internal supply unit, as for example shown in the embodiment of the washing machine shown in FIG. 3. The user can take out the wand 30 from compartment 77 and move it over a condensate covering 78 used as a treating area, when the stained laundry to be treated is placed thereon. The condensate covering 78 is formed slightly concave and has a draining hole (not shown) connecting the upper side of the condensate covering 78 to a condensate tank formed in the drawer 72 below the condensate covering 78. The condensate tank is normally used to collect condensate water condensed at a condenser of the condenser type dryer 70. Thereby, a double function is provided by the condensate tank, i.e. it collects condensed water and cleaning fluid used during ultrasonic cleaning. A level sensor arranged at the condensate tank can then be used to indicate the user that the condensed liquid capacity is reached for emptying the condensate tank, and it can also be used to interrupt the liquid supply to the ultrasonic wand 30 to prevent an overflow in the condensate tank.

FIGS. 5A and 5B show a washing machine 80 of a third embodiment in a partial perspective view. In FIG. 5A a detergent drawer 82 is fully retracted in. the main body 4 of the washing machine 80, while in FIG. 5B the detergent drawer 82 is in its fully extracted position to provide a work cover in its working position. The work cover 84 is placed on the upper side of the detergent drawer 82 and covers compartments 54, 56, 58 (compare FIG. 3 and the respective description of these compartments). Work cover 84 is used to treat the laundry thereon by the ultrasonic wand 30 being arranged here in a compartment 88 at the side of the detergent drawer 82. Excessive treating liquid used for ultrasonic cleaning flows through a hole 86 and drops into the main wash compartment 56 below the work cover 84. The connection of the ultrasonic wand 30 to the supply unit via the hose and the handling thereof is as described above, for example in connection with FIG. 3 or FIG. 2.

While in the shown embodiment the work cover 84 is only supported by the detergent drawer 82, in other embodiments not shown the work cover 84 can be formed as separate drawer which can be drawn out of the main body 4 as soon as the detergent drawer 82 has been pulled-out. Or in another embodiment the work cover 84 is connected to the detergent drawer 82 via a hinge, such that for filling the compartments 54, 56, 58 with detergents, the work cover can be swung aside.

FIG. 6 shows a forth embodiment of a washing machine 90 having a pivotably mounted tray 92 located over the detergent drawer formed like the detergent drawer 10 shown in FIG. 1, the detergent drawer 52 shown in FIG. 3 or the detergent drawer 82 shown in FIG. 5B.

FIGS. 7A to 7C show a fifth embodiment of a washing machine 96 having a swing tray 98 being pivotably mounted in a front middle region of the washing machine 96. FIG. 7A shows the washing machine, when the swing tray 98 is in its retracted position, FIG. 7B shows it in a position swung to the left side, and FIG. 7C shows the swing tray 98 swung to the right position.

FIG. 8 shows as block diagram the main elements of a washing machine or dryer 100 being representative for the control and internal configuration of the washing machines 2, 50, 80, 90 or 96, or the dryer 70 described above. The same elements have the same reference numerals, unless otherwise mentioned. The detergent drawer 10 being a representative of drawers 52, 72 or 82 is in its pulled-out position. The worktop drawer 12 is in its working position and is representative for drawers 72, work cover 84, swing trays 92 or 98, or can be omitted as in the embodiment shown in FIG. 3.

The washing and/or drying programs of the washing machine or dryer is controlled by a control unit 101. Control unit 101 controls the operation of liquid supply 106 connected via a liquid line running through the flexible hose 38 to the nozzle 102 of the ultrasonic wand 30. The liquid supply 106 is activated by the control unit 101 in response to pressing the fluid button 42 as described above. Liquid is fed to the liquid supply 106 from a valve 110 connected to the fresh water line 112 in case of a washing machine.

The electric ultrasonic signal is supplied to the ultrasonic transducer 104 of the wand 30 by an electric supply 108 under the control of the control unit 101 activated in response to pressing the ultrasonic button 40. A position detector 122 is assigned to the worktop drawer 12 and/or the detergent drawer 10 to detect the worktop drawer 12 and/or the detergent drawer 10 being in their pulled-out or working position. The signal from the position detector 122 is fed to the control unit 101 which then deactivates the liquid supply 106 and/or the electric supply 108 to prevent a malfunction of the ultrasonic wand 30. A drain channel 113 is symbolized here by a line between the detergent drawer 10 and a tub of the washing machine or a container 114 in case of a dryer. Preferably, a level switch 116 switches the liquid level within the tub 114 or container and activates a draining pump 118 pumping the liquid out of the tub or container 114 through a draining hose 120 to the outside of the washing machine or dryer 100.

Reference Numeral List

2 washing machine
4 main body
5 program selector
6 top cover
8 loading door
10 detergent drawer
12 worktop drawer
14 worktop
16 drain
18*a*, 18*b* recess
20 compartment
22 groove
24 grip
30 ultrasonic wand
32 proximal portion
34 distal portion
36 emitter
38 hose
39 opening
40 US button
42 fluid button
50 washing machine
52 detergent drawer
54 pre-wash compartment
56 main wash compartment
58 softener compartment
60 door
62 holder
64 compartment
70 dryer
71 body
72 drawer
74 loading door
76 program selector
77 storing compartment
78 condensate covering
80 washing machine
82 detergent drawer
84 work cover
86 hole
88 storing compartment
90 washing machine
92 swing tray
96 washing machine
98 swing tray
100 washing machine/dryer
101 control unit
102 nozzle unit
104 transducer
106 liquid supply
108 electric supply
110 valve
112 fresh water line
113 drain channel
114 tub/container
116 level switch
118 draining pump
120 draining hose
122 position detector

The invention claimed is:

1. A textile product treating apparatus, comprising:

a main body of the apparatus including a washing and/or drying unit;

an ultrasonic cleaning device comprising an ultrasonic transducer and an ultrasonic wave emitting surface;

a treatment area adapted to place a textile product to be treated thereon;

a moveable tray providing a generally planar worktop, wherein the treatment area is arranged on or over the generally planar worktop; and a moving mount connecting the movable tray to the main body and adapted to guide a movement of the moveable tray between a retracted position and a working position, wherein in the working position the tray and worktop extend beyond the base area of the main body, a drain provides a path for liquid to drain from the moveable tray to a receptacle of the apparatus and the moveable tray is arranged above a drawer that can be drawn out of the main body with the moveable tray remaining in the retracted position.

2. Apparatus according to claim 1, wherein the moveable tray comprises a rotary mounted tray pivotable horizontally between said retracted position and said working position.

3. Apparatus according to claim 2, wherein the rotary tray has the shape or approximately the shape of a circle, a section of a circle, an ellipse or a section of an ellipse.

4. Apparatus according to claim 2, wherein a pivoting point of the rotary tray is located in the middle or at a side of the front area of the main body.

5. Apparatus according to claim 1, wherein in the working position the moveable tray is at least partially located over the drawer.

6. Apparatus according to claim 5, wherein the drain discharges liquid into the drawer.

7. Apparatus according to claim 1, wherein the moveable tray has an engagement element being or coming in engagement with the drawer, when the moveable tray is moved from the retracted to the working position.

8. Apparatus according to claim 7, wherein, when moving the moveable tray from the retracted to the working position, the drawer is at least partially drawn out of the main body by the engagement element and/or a draining connection between the moveable tray and the drawer is established.

9. Apparatus according to claim 1, wherein the moveable tray is mounted on the drawer.

10. Apparatus according to claim 9, wherein the moveable tray is pivotably mounted on the drawer.

11. Apparatus according to claim 1, further comprising a compartment within which the ultrasonic device fits for storage while connected by a line to a supply unit, said compartment and ultrasonic device therein being moveable with said moveable tray between the retracted position and said working position unimpeded by said supply line.

12. Apparatus according to claim 1, wherein the drawer comprises a compartment for storing inside the drawer the ultrasonic device and/or a portion of a hose connecting the ultrasonic device to a supply unit, the drawer being a detergent and/or a tank unit drawer.

13. A textile product treating apparatus, comprising:

a main body of the apparatus including a washing and/or drying unit providing a treatment chamber;

an ultrasonic cleaning device comprising an ultrasonic transducer and an ultrasonic wave emitting surface;

an additives drawer;

a treatment area adapted to place a textile product to be treated thereon;

a moveable tray providing a generally planar worktop, wherein the treatment area is arranged on or over the generally planar worktop; and a moving mount connecting the movable tray to the main body and adapted to guide a movement of the moveable tray between a retracted position and a working position, wherein the apparatus further comprises a compartment within which the ultrasonic cleaning device fits for storage while connected by a line to a supply unit, said compartment and ultrasonic cleaning device therein being moveable with said moveable tray between the retracted position and said working position unimpeded by said supply line.

14. Apparatus according to claim 13, wherein in the retracted position the moveable tray is retracted in the main body.

15. Apparatus according to claim 13, wherein by the moving mount the moveable tray is retracted at the front side of the main body in the retracted position.

16. Apparatus according to claim 13, wherein the ultrasonic cleaning device is a handheld device and/or is connected by a flexible hose to the main body.

17. Apparatus according to claim 13, wherein the moveable tray comprises a sink, and the sink comprises a drain, for discharging a liquid from the sink.

18. Apparatus according to claim 13, comprising a sealing device at least partially sealing an opening of the main body when the moveable tray is in the working position.

19. Apparatus according to claim 13, wherein the ultrasonic device is connected by a hose to a supply unit providing at lease a liquid for the ultrasonic device.

20. Apparatus according to claim 19, wherein the supply unit comprises a liquid tank adapted to store liquid.

21. A textile product treating apparatus according to claim 13, wherein said ultrasonic cleaning device further comprises:

at least a first body portion and a second body portion being moveable relative to each other;

characterized in that the first and second body portions are connected by a connecting means having at least two connecting positions, wherein the orientation of a first main axis of the first body portion and of a second main axis of the second body portion relative to each other is different in the at least two connection positions.

22. Apparatus according to claim 13, wherein the moveable tray comprises an engagement element that engages with the drawer when the moveable tray is moved from the retracted position to the working position, to cause the drawer to move with it.

23. A textile product treating apparatus, comprising:

a main body of the apparatus including a washing and/or drying unit providing a treatment chamber;

an ultrasonic cleaning device comprising an ultrasonic transducer and an ultrasonic wave emitting surface;

an additives drawer;

a treatment area adapted to place a textile product to be treated thereon;

a moveable tray providing a generally planar worktop, wherein the treatment area is arranged on or over the generally planar worktop; and a moving mount connecting the movable tray to the main body and adapted to guide a movement of the moveable tray between a retracted position and a working position, wherein in the working position the moveable tray and worktop are at least partially located over the additives drawer that can be drawn out of the main body with the moveable tray remaining in the retracted position.

24. Apparatus according to claim 23, wherein the moveable tray comprises a drain for removing liquid from the treatment area, said drain discharging said liquid into the drawer.

25. A textile product treating apparatus, comprising:

a main body of the apparatus including a washing and/or drying unit;

an ultrasonic cleaning device comprising an ultrasonic transducer and an ultrasonic wave emitting surface;

a treatment area adapted to place a textile product to be treated thereon;

a moveable tray providing a generally planar worktop, wherein the treatment area is arranged on or over the generally planar worktop; and a moving mount connecting the movable tray to the main body and adapted to guide a movement of the moveable tray between a retracted position and a working position, wherein the moveable tray is arranged above a drawer and has an engagement element that comes into engagement with the drawer when the moveable tray is moved from the retracted position to the working position, to cause the drawer to move with it.

* * * * *